US008866413B2

(12) United States Patent
Cao et al.

(10) Patent No.: US 8,866,413 B2
(45) Date of Patent: Oct. 21, 2014

(54) LED DRIVE CIRCUIT

(71) Applicant: Shenzhen China Star Optoelectronics Technology Co., Ltd., Guangdong (CN)

(72) Inventors: Dan Cao, Guangdong (CN); Xiang Yang, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 13/824,396

(22) PCT Filed: Jan. 25, 2013

(86) PCT No.: PCT/CN2013/070979

§ 371 (c)(1), (2), (4) Date: Mar. 18, 2013

(87) PCT Pub. No.: WO2014/107926

PCT Pub. Date: Jul. 17, 2014

(65) Prior Publication Data

US 2014/0197742 A1 Jul. 17, 2014

(30) Foreign Application Priority Data

Jan. 11, 2013 (CN) ..... 2013 1 0010223

(51) Int. Cl.
*H05B 37/02* (2006.01)
*H05B 33/08* (2006.01)

(52) U.S. Cl.
CPC ..... *H05B 33/0815* (2013.01)
USPC ..... 315/307; 315/186; 315/276

(58) Field of Classification Search
USPC ..... 315/185 R, 186, 224, 225, 247, 274, 315/276, 282, 291, 294, 297, 307, 312
See application file for complete search history.

(56) References Cited

U.S. PATENT DOCUMENTS

| | | | | |
|---|---|---|---|---|
| 8,378,593 | B2 * | 2/2013 | Koolen | 315/308 |
| 2010/0295470 | A1 * | 11/2010 | Koutensky | 315/294 |
| 2010/0320934 | A1 * | 12/2010 | Liu et al. | 315/294 |
| 2010/0320937 | A1 * | 12/2010 | Huang et al. | 315/297 |
| 2011/0175543 | A1 * | 7/2011 | Sun et al. | 315/291 |
| 2013/0057163 | A1 * | 3/2013 | Sutardja et al. | 315/185 R |
| 2013/0077353 | A1 * | 3/2013 | Kuang et al. | 363/20 |

* cited by examiner

*Primary Examiner* — Tung X Le

(57) ABSTRACT

An LED drive circuit, which comprises a transformer, an MOS tube, a power regulating resistor, a direct current isolation circuit, a rectifying circuit, and a voltage control circuit; when the voltage of the control terminal of the voltage control circuit is higher than the threshold voltage of the MOS tube, the MOS tube is on, a current from an external power supply flows through the first winding of the transformer, the MOS tube and the power regulating resistor successively; when the voltage of the power regulating resistor is close to the voltage of the reference terminal of the voltage control circuit, the MOS tube is cut off, the second winding of the transformer charges the capacitor of the MOS tube via the direct current isolation circuit, the rectifying circuit is on, and the first winding of the transformer supplies power to the LED load via the rectifying circuit.

20 Claims, 2 Drawing Sheets

LED DRIVE CIRCUIT

FIELD OF THE INVENTION

Figure 1:
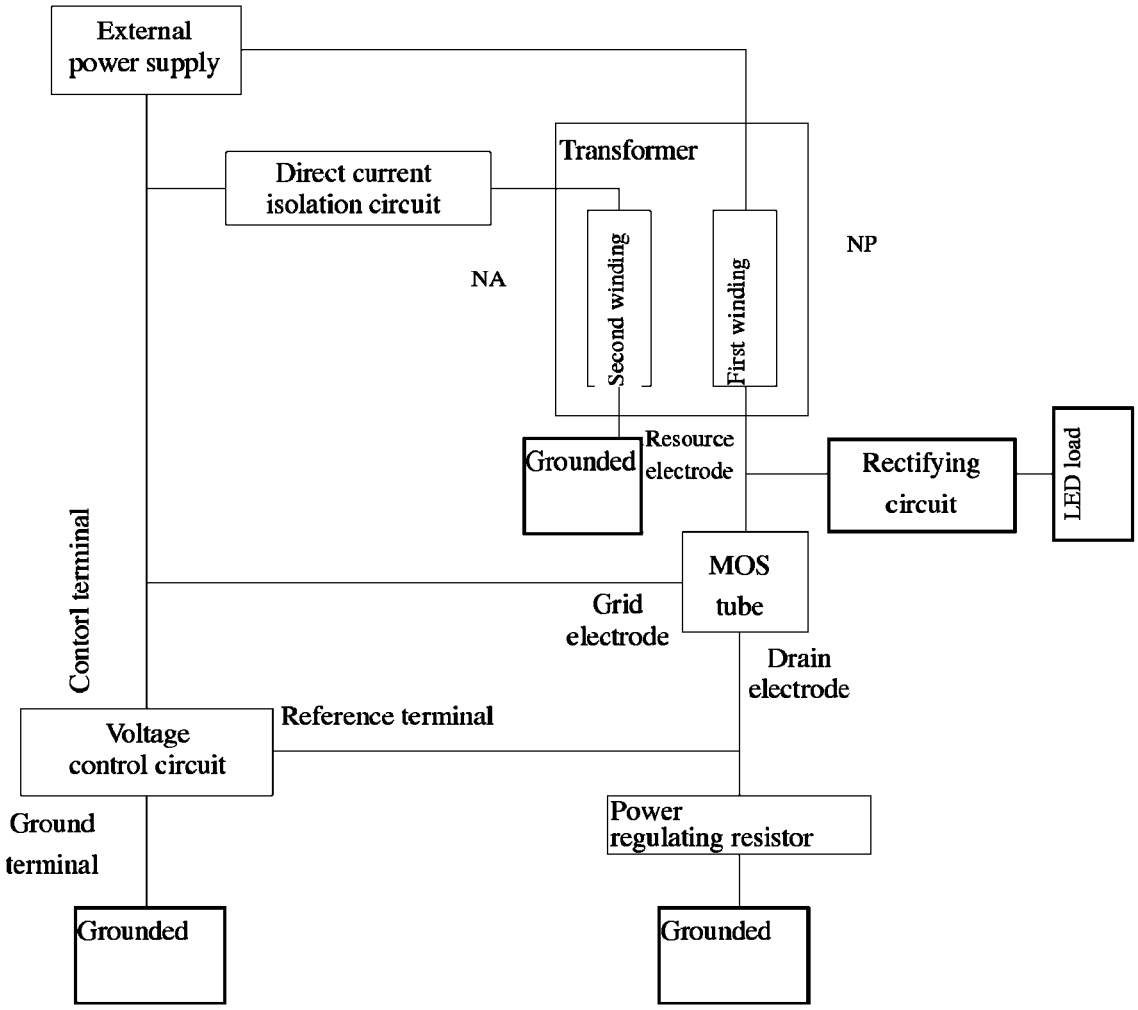

The present invention relates to an LED drive circuit, and more particularly to an LED drive circuit without a power management IC.

BACKGROUND OF THE INVENTION

A drive circuit, as an important part of an LED application product, has gradually increased technical maturity with expansion of the LED market. A number of mature drive circuit products have emerged both in the field of lighting and backlight sources and in the field of display panels. Currently, most of these existing drive circuits need to be controlled by power management ICs. However, all the commonly used power management ICs generally have a complex structure and a high price, their application to the LED drive circuit will make the whole structure of the drive circuit complicated, and it is not conducive to reduction of the manufacturing cost of the drive circuit.

SUMMARY OF THE INVENTION

Aiming at the defects of complicated structure and high cost of the LED drive circuit in the prior art, the technical problem to be solved by the present invention is to provide an LED drive circuit to substitute the power management IC so as to reduce manufacturing cost.

The present invention adopts the following technical solution to solve its technical problem: an LED drive circuit is provided, comprising a transformer, an MOS tube, a power regulating resistor, a direct current isolation circuit, a rectifying circuit, and a voltage control circuit;

the transformer includes a first winding and a second winding; the first winding is connected at one end to an external power supply and at the other end to a source electrode of the MOS tube, and the drain electrode of the MOS tube is grounded via the power regulating resistor; the second winding is grounded at one end, and connected at the other end to a grid electrode of the MOS tube via the direct current isolation circuit;

the voltage control circuit includes a control terminal for controlling on/off of the MOS tube, a reference terminal for regulating voltage of the control terminal, and a ground terminal; the control terminal is connected to the external power supply and the grid electrode of the MOS tube, the reference terminal is grounded via the power regulating resistor, and the ground terminal is grounded directly;

the transformer and the voltage control circuit cooperate to control on/off of the MOS tube; when the MOS tube is on, a current from the external power supply flows through the first winding of the transformer, the MOS tube and the power regulating resistor successively, and the rectifying circuit is cut off; when the MOS tube is cut off, the second winding of the transformer charges a capacitor of the MOS tube by the direct current isolation circuit, the rectifying circuit is on, and the first winding of the transformer supplies power to an LED load via the rectifying circuit.

Preferably, the rectifying circuit is a rectifying diode.

Preferably, the voltage control circuit includes a TL432 chip or a TL431 chip.

Preferably, the direct current isolation circuit includes a direct current isolation capacitor and a direct current isolation resistor connected in series, the direct current insulation capacitor is connected to the second winding of the transformer, and the direct current insulation resistor is connected to the grid electrode of the MOS tube.

Preferably, the drive circuit includes a compensating circuit which is connected at its input terminal to the control terminal of the voltage control circuit and at its output terminal to the reference terminal of the voltage control circuit.

Preferably, the compensating circuit includes a compensating resistor and a compensating capacitor connected in series.

Preferably, the drive circuit includes a protective circuit for preventing breakdown of the MOS tube, the protective circuit being connected at its input terminal to the control terminal of the voltage control circuit and at its output terminal to the ground terminal of the voltage control circuit.

Preferably, the protective circuit includes a voltage stabilizing diode and a protective resistor connected in parallel.

Preferably, a control-terminal voltage regulating resistor for regulating voltage of the control terminal of the voltage control circuit is connected between the control terminal of the voltage control circuit and the external power supply.

Preferably, a reference-terminal voltage regulating resistor for regulating voltage of the reference terminal of the voltage control circuit is connected between the reference terminal of the voltage control circuit and the power regulating resistor.

Another technical solution of the present invention is to provide an LED drive circuit, wherein the drive circuit comprises a transformer, an MOS tube, a power regulating resistor, a direct current isolation circuit, a rectifying circuit, and a voltage control circuit; the source electrode of the MOS tube receives input voltage of the transformer, and the drain electrode of the MOS tube is grounded through the power regulating resistor; the grid electrode of the MOS tube receives output voltage of the transformer via the direct current isolation circuit;

the voltage control circuit includes a control terminal for controlling on/off of the MOS tube, a reference terminal for regulating voltage of the control terminal, and a ground terminal; the control terminal receives the output voltage of the external power supply and is connected to the grid electrode of the MOS tube, the ground terminal is grounded directly, and the reference terminal is grounded via the power regulating resistor;

the transformer and the voltage control circuit cooperate to control on/off of the MOS tube; when the MOS tube is on, the input voltage of the transformer forms a current in the transformer, the MOS tube and the power regulating resistor; when the MOS tube is cut off, the output voltage of the transformer charges the capacitor of the MOS tube via the transformer, the direct current isolation circuit and the MOS tube, and meanwhile the transformer supplies power to the LED load via the rectifying circuit.

Preferably, the rectifying circuit is a rectifying diode.

Preferably, the voltage control circuit includes a TL432 chip or a TL431 chip.

Preferably, the direct current isolation circuit includes a direct current isolation capacitor and a direct current isolation resistor connected in series, and the direct current insulation capacitor receives the output voltage of the transformer.

Preferably, the drive circuit further includes a compensating circuit which receives the output voltage of the external power supply at its input terminal and is grounded via the power regulating resistor at its output terminal.

Preferably, the compensating circuit includes a compensating resistor and a compensating capacitor connected in series.

Preferably, the drive circuit further includes a protective circuit for preventing breakdown of the MOS tube, the protective circuit receiving the output voltage of the external power supply at its input terminal and being grounded directly at its output terminal.

Preferably, the protective circuit includes a voltage stabilizing diode and a protective resistor connected in parallel.

Preferably, the control terminal of the voltage control circuit receives the output voltage of the external power supply via the control-terminal voltage regulating resistor, which is used for regulating the voltage of the control terminal of the voltage control circuit.

Preferably, a reference-terminal voltage regulating resistor for regulating voltage of the reference terminal of the voltage control circuit is connected between the reference terminal of the voltage control circuit and the power regulating resistor.

With the LED drive circuit of the present invention, the transformer and the TL432 chip or the TL431 chip can be substituted for the more complex and expensive power management IC in the prior art, thus simplifying the LED drive circuit and reducing the manufacturing cost.

BRIEF DESCRIPTIONS OF THE DRAWINGS

Figure 2:
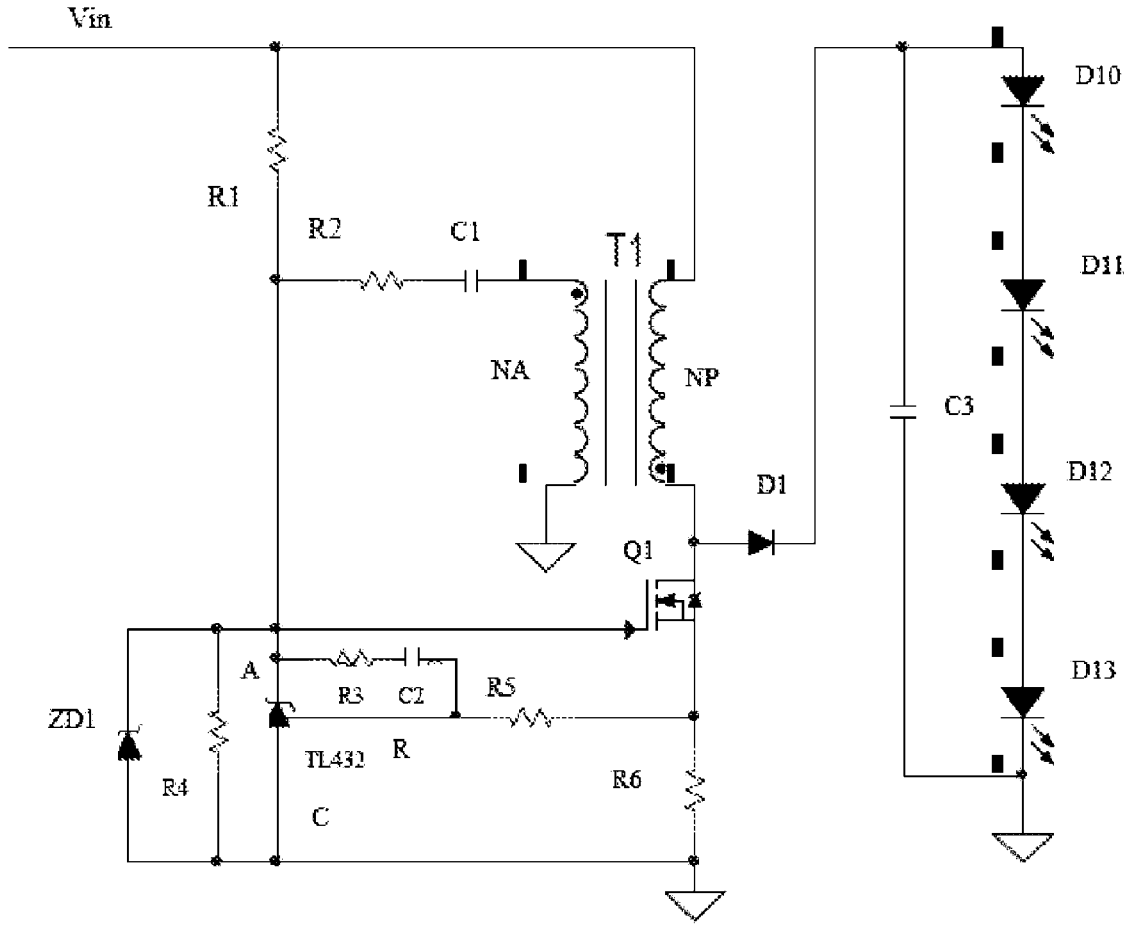

The present invention will further be explained with reference to drawings and examples. In the drawings:

FIG. 1 is a block diagram showing the structure of a preferred example of the LED drive circuit of the present invention; and FIG. 2 is a schematic diagram showing the circuit of a preferred example of the LED drive circuit of the present invention.

DETAILED DESCRIPTION OF THE EMBODIMENTS

The present invention provides an LED drive circuit, wherein a transformer, an MOS tube and a voltage control circuit (preferably the existing TL432 chip or TL431 chip) are substituted for the existing power management IC to control the drive circuit.

As shown in FIG. 1, the LED drive circuit of the present invention includes a transformer, an MOS tube, a power regulating resistor, a rectifying circuit, a voltage control circuit and a direct current isolation circuit, wherein the power regulating resistor is used for regulating the power of the entire drive circuit, and the transformer is a double-winding transformer; a first winding NP is connected at one end to an existing external power supply and the received voltage thereof is the input voltage of the transformer; a second winding NA is grounded at one end; the voltage control circuit includes a control terminal for controlling on/off of the MOS tube, a reference terminal for regulating voltage of the control terminal, and a ground terminal, wherein the control terminal is respectively connected to the external power supply and the grid electrode of the MOS tube, the reference terminal is grounded via the power regulating resistor, and the ground terminal is grounded directly. In this example the MOS tube is an N-channel MOS tube.

The first winding NP of the transformer is connected at one end to the external power supply and at the other end to a source electrode of the MOS tube, and the drain electrode of the MOS tube is grounded via the power regulating resistor; the second winding NA of the transformer is grounded at one end, and connected at the other end to a grid electrode of the MOS tube via the direct current isolation circuit; the voltage outputted by the second winding of the transformer is the output voltage of the transformer; and the first winding NP of the transformer is further connected to the LED load via the rectifying circuit.

In this example, the above first winding NP is used for supplying power to the LED load, and the second winding NA is used for charging the capacitor of the MOS tube. When the first winding NP cannot supply power to the LED load, the terminal of the first winding NP connected to the external power supply is an anode, while the terminal connected to the source electrode of the MOS tube is a cathode; the terminal of the second winding NA that is grounded is an anode, while the other terminal is a cathode. When the first winding NP can supply power to the LED load, the terminal of the first winding NP connected to the external power supply is a cathode, while the terminal connected to the source electrode of the MOS tube is an anode; the terminal of the second winding NA that is grounded is a cathode, while the other terminal is an anode.

The rectifying circuit is used for converting alternating current transferred from the transformer to the LED load into direct current. The rectifying circuit is usually composed of a main circuit, a filter, etc., with the filter connected between the main circuit and the load for filtering out the AC component in the pulsating DC voltage; the main circuit is mostly composed of a silicon rectifying diode and a thyristor. In this example, the rectifying circuit can be replaced by a rectifying diode, and the rectifying diode converts the alternating current from the first winding NP into the pulsating direct current by making use of the unidirectional conductive characteristics of the PN junction.

The MOS tube is used for controlling on/off of the current between the transformer and the LED load; when the MOS tube is on, and the rectifying circuit is cut off, and the transformer is disconnected from the LED load; when the MOS tube is cut off, the rectifying circuit is on, and the transformer is connected with the LED load.

The voltage control circuit is used for controlling on/off of the MOS tube; when the voltage of its control terminal is higher than the threshold voltage of the MOS tube, the MOS tube is on; when the voltage of its control terminal is lower than the threshold voltage of the MOS tube, the MOS tube is cut off. The voltage control circuit is the existing TL432 chip or TL431 chip; the TL432 chip is used in this example, wherein the cathode C is corresponding to the control terminal, the anode A is corresponding to the ground terminal, and the reference terminal R is corresponding to the reference terminal; the TL432 chip has a reference voltage of 1.249 V, and the TL431 chip has a reference voltage of 2.5 V.

The power regulating resistor is used for regulating the voltage of the reference terminal of the voltage control circuit; when the voltage of the power regulating resistor is close to the reference voltage of the voltage control circuit, the voltage control circuit regulates the voltage of its control terminal to the low voltage state, and the MOS tube is cut off.

The direct current isolation circuit is used for preventing the direct current from flowing into the second winding of the transformer.

In the specific implementing process, the voltage inputted by the external power supply (the output voltage of the external power supply is the voltage inputting into the entire drive circuit) is increased from zero to a preset fixed value, the voltage of the control terminal of the voltage control circuit is increased with the input voltage, and the control terminal of the voltage control circuit is in the high voltage state; when the voltage of the control terminal of the voltage control circuit is higher than the threshold voltage of the MOS tube, the MOS tube is on, a current from the external power supply flows through the first winding of the transformer, the MOS tube and the power regulating resistor successively, and meanwhile the transformer T1 stores energy, the rectifying circuit is cut off, and the transformer is disconnected from the LED load; the voltage of the power regulating resistor is increased with the current flowing through the power regulating resistor; when the voltage of the power regulating resistor is close to the voltage of the reference terminal of the voltage control circuit, the voltage control circuit regulates the control terminal to be in the low voltage state, the MOS tube is cut off, the second winding of the transformer charges a capacitor of the MOS tube via the direct current isolation circuit, and meanwhile the rectifying circuit is on, and the first winding of the transformer supplies power to the LED load via the rectifying circuit; the voltage of the capacitor of the MOS tube goes up continuously with the power supply of the second winding of the transformer; when the voltage of the capacitor of the MOS tube is higher than the threshold voltage of the MOS tube, the MOS tube is on, the voltage control circuit regulates the control terminal to be in the high voltage state, the MOS tube is kept on, a current from the external power supply flows through the first winding of the transformer, the MOS tube and the power regulating resistor successively, and meanwhile the transformer T1 stores energy, the rectifying circuit is cut off, and the transformer is disconnected from the LED load. With the above process repeated in cycle, the present invention controls the LED drive circuit by the voltage control circuit and the transformer.

In a preferred example of the present invention, the voltage control circuit can be replaced by the TL432 chip or the TL431 chip; the direct current isolation circuit can be replaced by a direct current isolation capacitor and a direct current isolation resistor connected in series, wherein the direct current insulation capacitor is connected to the second winding of the transformer, and the direct current insulation resistor is connected to the grid electrode of the MOS tube.

In a preferred example of the present invention, the above LED drive circuit can further include a compensating circuit, which is connected at its input terminal to the control terminal of the voltage control circuit and at its output terminal to the reference terminal of the voltage control circuit, and the voltage control circuit can further include a compensating resistor and a compensating capacitor connected in series.

In a preferred example of the present invention, the drive circuit can further include a protective circuit for preventing breakdown of the MOS tube, the protective circuit is connected at its input terminal to the control terminal of the voltage control circuit and at its output terminal to the ground terminal of the voltage control circuit, and the protective circuit can further includes a voltage stabilizing diode and a protective resistor connected in parallel.

In a preferred example of the present invention, a control-terminal voltage regulating resistor for regulating voltage of the control terminal of the voltage control circuit is connected between the control terminal of the voltage control circuit and the external power supply.

In a preferred example of the present invention, a reference-terminal voltage regulating resistor for regulating voltage of the reference terminal of the voltage control circuit is connected between the reference terminal of the voltage control circuit and the power regulating resistor.

FIG. 2 is a circuit diagram of a specific example of the LED drive circuit of the present invention. As shown in FIG. 2, the transformer is T1, whose first winding NP is connected at one end to an external power supply and at the other end to a source electrode of the MOS tube Q1, with the drain electrode of the MOS tube grounded via the power regulating resistor R6; the second winding NA of the transformer T1 is grounded at one end, and connected at the other end to the direct current isolation resistor R2 and the grid electrode of the MOS tube Q1 via the direct current isolation capacitor C1.

The voltage control circuit is a TL432 chip, whose cathode C is respectively connected to the external power supply and the grid electrode of the MOS tube Q1, a control terminal regulating resistor R1 being connected between the cathode C and the external power supply; the anode A of the TL432 chip is grounded, and the reference terminal R of the TL432 chip is grounded via the reference-terminal regulating resistor R5 and the power regulating resistor R6.

The protective circuit is a voltage stabilizing diode ZD1 and a protective resistor R4 in parallel, and the voltage stabilizing diode ZD1 and the protective resistor R4 are connected in parallel between the cathode C and the anode A of the TL432 chip.

The compensating circuit is a compensating resistor R3 and a compensating capacitor C2 in series, the current inputted by the external power supply flows successively through the control-terminal regulating resistor R1, the compensating resistor R3, the compensating capacitor C2, the reference-terminal regulating resistor R5 and the power regulating resistor R6.

The rectifying circuit is a rectifying diode D1.

The LED load is a third capacitor C3 and four light-emitting diodes D10-D13 connected in parallel.

In the specific implementing process, the voltage of the cathode C of the TL432 chip increases with the input voltage Vin, when the voltage of the cathode C is higher than the threshold voltage of the MOS tube Q1, the MOS tube Q1 is on, such that the input current flows through the first winding NP of the transformer T1, the MOS tube Q1 and the power regulating resistor R6, and meanwhile the transformer T1 stores energy and the rectifying diode D1 is cut off (here the first winding NP is positive at the top and negative at the bottom, and the third capacitor C3 supplies power to the LED load; the second winding NA is negative at the top and positive at the bottom, and there is no current flowing through the direct current insulation capacitor C1 and the direct current isolation resistor R2); the voltage of R6 increases continuously with the current flowing through the power regulating resistor R6; when the voltage of R6 is close to the reference voltage 1.249 V of the TL432 chip, the inner portion of the TL432 chip will pull the voltage of the cathode C to a low level, and the voltage of the grid electrode is lower than the threshold voltage of the MOS tube Q1, such that the MOS tube Q1 will be turned off; here the transformer T1 releases energy, the second winding NA charges the capacitor of the MOS tube Q1, and meanwhile the rectifying diode D1 is on and the first winding NP supplies power to the LED load (NP is negative at the top and positive at the bottom, NA is positive at the top and negative at the bottom, and there will be a current flowing through the direct current insulation capacitor C1 and the direct current isolation resistor R2); when the voltage of the capacitor of the MOS tube Q1 is higher than the threshold voltage of the MOS tube Q1, the MOS tube Q1 is on again. The above process is thus repeated. Thereby the LED drive circuit can be controlled by the TL432 chip and the transformer T1.

All the above are only the preferred examples of the present invention, and do not limit the present invention. For those skilled in the art, the present invention can have a variety of alterations and changes. Any amendments, equivalent replacements, improvements, etc. within the spirit and principle of the present invention shall fall within the scope of the claims of the present invention.

What is claimed is:

1. An LED drive circuit, comprising a transformer, an MOS tube, a power regulating resistor, a direct current isolation circuit, a rectifying circuit, and a voltage control circuit; wherein:

the transformer comprises a first winding and a second winding; the first winding is connected at one end to an external power supply and at the other end to a source electrode of the MOS tube, a drain electrode of the MOS tube is grounded via the power regulating resistor; the second winding is grounded at one end, and connected at the other end to a grid electrode of the MOS tube via the direct current isolation circuit;

the voltage control circuit comprises a control terminal for controlling on/off of the MOS tube, a reference terminal for regulating voltage of the control terminal, and a ground terminal; the control terminal is connected to the external power supply and the grid electrode of the MOS tube, the reference terminal is grounded via the power regulating resistor, and the ground terminal is grounded directly; and the transformer and the voltage control circuit cooperate to control on/off of the MOS tube; when the MOS tube is on, a current from the external power supply flows through the first winding of the transformer, the MOS tube and the power regulating resistor successively, and the rectifying circuit is cut off; when the MOS tube is cut off, the second winding of the transformer charges a capacitor of the MOS tube by the direct current isolation circuit, the rectifying circuit is on, and the first winding of the transformer supplies power to an LED load via the rectifying circuit.

2. The LED drive circuit according to claim 1, wherein the rectifying circuit is a rectifying diode.

3. The LED drive circuit according to claim 1, wherein the voltage control circuit comprises a TL432 chip or a TL431 chip.

4. The LED drive circuit according to claim 1, wherein the direct current isolation circuit comprises a direct current isolation capacitor and a direct current isolation resistor connected in series, the direct current insulation capacitor is connected to the second winding of the transformer, and the direct current insulation resistor is connected to the grid electrode of the MOS tube.

5. The LED drive circuit according to claim 1, wherein the drive circuit comprises a compensating circuit which is connected at its input terminal to the control terminal of the voltage control circuit and at its output terminal to the reference terminal of the voltage control circuit.

6. The LED drive circuit according to claim 5, wherein the compensating circuit comprises a compensating resistor and a compensating capacitor connected in series.

7. The LED drive circuit according to claim 1, wherein the drive circuit comprises a protective circuit for preventing breakdown of the MOS tube, the protective circuit being connected at its input terminal to the control terminal of the voltage control circuit and at its output terminal to the ground terminal of the voltage control circuit.

8. The LED drive circuit according to claim 7, wherein the protective circuit comprises a voltage stabilizing diode and a protective resistor connected in parallel.

9. The LED drive circuit according to claim 1, wherein a control-terminal voltage regulating resistor for regulating voltage of the control terminal of the voltage control circuit is connected between the control terminal of the voltage control circuit and the external power supply.

10. The LED drive circuit according to claim 1, wherein a reference-terminal voltage regulating resistor for regulating voltage of the reference terminal of the voltage control circuit is connected between the reference terminal of the voltage control circuit and the power regulating resistor.

11. An LED drive circuit, wherein the drive circuit comprises a transformer, an MOS tube, a power regulating resistor, a direct current isolation circuit, a rectifying circuit, and a voltage control circuit; the source electrode of the MOS tube receives input voltage of the transformer, and the drain electrode of the MOS tube is grounded through the power regulating resistor; the grid electrode of the MOS tube receives output voltage of the transformer via the direct current isolation circuit;

the voltage control circuit comprises a control terminal for controlling on/off of the MOS tube, a reference terminal for regulating voltage of the control terminal, and a ground terminal; the control terminal receives the output voltage of the external power supply and is connected to the grid electrode of the MOS tube, the ground terminal is grounded directly, and the reference terminal is grounded via the power regulating resistor; and the transformer and the voltage control circuit cooperate to control on/off of the MOS tube; when the MOS tube is on, the input voltage of the transformer forms a current in the transformer, the MOS tube and the power regulating resistor; when the MOS tube is cut off, the output voltage of the transformer charges the capacitor of the MOS tube via the transformer, the direct current isolation circuit and the MOS tube, and meanwhile the transformer supplies power to the LED load via the rectifying circuit.

12. The LED drive circuit according to claim 11, wherein the rectifying circuit is a rectifying diode.

13. The LED drive circuit according to claim 11, wherein the voltage control circuit comprises a TL432 chip or a TL431 chip.

14. The LED drive circuit according to claim 11, wherein the direct current isolation circuit comprises a direct current isolation capacitor and a direct current isolation resistor connected in series, and the direct current insulation capacitor receives the output voltage of the transformer.

15. The LED drive circuit according to claim 11, wherein the drive circuit further comprises a compensating circuit which receives the output voltage of the external power supply at its input terminal and is grounded via the power regulating resistor at its output terminal.

16. The LED drive circuit according to claim 15, wherein the compensating circuit comprises a compensating resistor and a compensating capacitor connected in series.

17. The LED drive circuit according to claim 11, wherein the drive circuit further comprises a protective circuit for preventing breakdown of the MOS tube, the protective circuit receiving the output voltage of the external power supply at its input terminal and being grounded directly at its output terminal.

18. The LED drive circuit according to claim 17, wherein the protective circuit comprises a voltage stabilizing diode and a protective resistor connected in parallel.

19. The LED drive circuit according to claim 11, wherein the control terminal of the voltage control circuit receives the output voltage of the external power supply via the control-terminal voltage regulating resistor which is used for regulating the voltage of the control terminal of the voltage control circuit.

20. The LED drive circuit according to claim 11, wherein a reference-terminal voltage regulating resistor for regulating voltage of the reference terminal of the voltage control circuit is connected between the reference terminal of the voltage control circuit and the power regulating resistor.

* * * * *